US012492813B2

(12) United States Patent
Takahashi et al.

(10) Patent No.: US 12,492,813 B2
(45) Date of Patent: Dec. 9, 2025

(54) COOLING CHANNEL STRUCTURE AND BURNER

(71) Applicant: MITSUBISHI HEAVY INDUSTRIES, LTD., Tokyo (JP)

(72) Inventors: Yuta Takahashi, Tokyo (JP); Tatsuya Kameyama, Tokyo (JP); Yoshitaka Nakayama, Tokyo (JP); Toshiyuki Yamashita, Tokyo (JP); Yasuharu Chuman, Tokyo (JP); Shuji Tanigawa, Tokyo (JP); Takafumi Shinogi, Tokyo (JP); Ryuhei Takashima, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 952 days.

(21) Appl. No.: 17/640,077

(22) PCT Filed: Jan. 24, 2020

(86) PCT No.: PCT/JP2020/002553
§ 371 (c)(1),
(2) Date: Mar. 3, 2022

(87) PCT Pub. No.: WO2021/049053
PCT Pub. Date: Mar. 18, 2021

(65) Prior Publication Data

US 2022/0325886 A1 Oct. 13, 2022

(30) Foreign Application Priority Data

Sep. 13, 2019 (JP) ..... 2019-166736

(51) Int. Cl.
*F23D 14/78* (2006.01)
*F28F 1/40* (2006.01)

(52) U.S. Cl.
CPC ..... *F23D 14/78* (2013.01); *F28F 1/40* (2013.01); *F28F 2210/06* (2013.01)

(58) Field of Classification Search
CPC ... F23D 11/443; F23C 2203/10; F23C 99/008
See application file for complete search history.

(56) References Cited

U.S. PATENT DOCUMENTS 2,241,186 A * 5/1941 Coons ..... F28D 7/024 165/145
3,051,146 A * 8/1962 Clarkson ..... F24H 1/43 56/DIG. 3

(Continued)

FOREIGN PATENT DOCUMENTS

DE 2750889 A1 * 5/1979
FR 2680741 A1 * 3/1993 ..... B60S 1/487

(Continued)

OTHER PUBLICATIONS

International Search Report issued Mar. 10, 2020 in International Application No. PCT/JP2020/002553.

(Continued)

*Primary Examiner* — Jorge A Pereiro
(74) *Attorney, Agent, or Firm* — Wenderoth, Lind & Ponack, L.L.P.

(57) ABSTRACT

A cooling channel structure includes a tubular member with openings at both ends. In an inner portion of the tubular member or on a surface of the tubular member, as cooling channels for a cooling medium for cooling the tubular member, spiral outer surface-side channels are located on an outer surface side of the tubular member, at least one inner surface-side channel is located on an inner surface side of the tubular member, and folded channels, respectively, connect the outer surface-side channels and the at least one inner surface-side channel on one end side of the tubular member.

11 Claims, 14 Drawing Sheets

(56) References Cited

U.S. PATENT DOCUMENTS

| | | | | |
|---|---|---|---|---|
| 3,149,613 | A * | 9/1964 | Anschutz | F23D 1/00 431/160 |
| 3,693,324 | A * | 9/1972 | McNeil | F22B 3/04 96/174 |
| 4,451,960 | A * | 6/1984 | Molitor | B21D 53/027 228/183 |
| 5,816,314 | A * | 10/1998 | Wiggs | F24T 10/15 165/45 |
| 6,463,757 | B1 * | 10/2002 | Dickson | F25B 43/006 62/509 |
| 10,267,515 | B2 * | 4/2019 | Adriany | F23D 14/22 |
| 2006/0231242 | A1 * | 10/2006 | Hawranek | F28D 1/0233 165/157 |
| 2011/0068522 | A1 | 3/2011 | Tierney et al. | |
| 2014/0321921 | A1 * | 10/2014 | Breidenbach | F24T 10/13 405/184 |
| 2018/0245855 | A1 * | 8/2018 | Deivasigamani | F28F 13/06 |
| 2019/0024987 | A1 | 1/2019 | Moore et al. | |
| 2021/0215334 | A1 * | 7/2021 | Kitada | F23D 14/78 |

FOREIGN PATENT DOCUMENTS

| | | |
|---|---|---|
| JP | 2008-190854 | 8/2008 |
| JP | 2015-161460 | 9/2015 |
| JP | 2018-91599 | 6/2018 |
| JP | 2018-132248 | 8/2018 |
| JP | 2019-39659 | 3/2019 |

OTHER PUBLICATIONS

Office Action issued May 23, 2023 in counterpart Japanese Application No. 2019-166736, with English language machine translation.

* cited by examiner

COOLING CHANNEL STRUCTURE AND BURNER

TECHNICAL FIELD

The present disclosure relates to a cooling channel structure and a burner.

BACKGROUND

In order to cool a structure exposed to a high-temperature atmosphere, a cooling channel through which a low-temperature cooling medium flows may be provided in an inner portion (structure itself) or on the surface of the structure. For example, JP 2018-132248 A discloses a cooling channel structure where one cooling pipe is spirally wound around a tubular structure (tubular member) to cool the structure. Further, JP 2015-161460 A discloses a cooling channel structure where a structure is cooled by a shield tube which internally includes a plurality of cooling channels extending along the axial direction.

In the configuration described in JP 2018-132248 A, while the structure can be cooled uniformly, it is likely that a channel length of the cooling pipe is long, a pressure loss in the cooling channel is large, and a driving force for feeding the cooling medium is large. Further, in the configuration of JP 2015-161460 A, since the structure is cooled by the plurality of cooling channels extending along the axial direction, as compared with the configuration of JP 2018-132248 A, while the length of one cooling channel can be short, it is difficult to uniformly cool the structure if a distribution of a heat load on the structure is biased, and the structure is likely to be cooled unevenly.

Meanwhile, JP 2018-91599 A discloses a cooling channel structure where a tubular structure is cooled by a plurality of spiral channels provided from one end side to another end side of the structure. With such configuration, a channel length of the spiral channel can be shortened as compared with a case where the structure is cooled by one spiral channel, making it possible to uniformly cool the structure while suppressing an increase in pressure loss in a cooling channel.

CITATION LIST

Patent Literature

Patent Document 1: JP2018-132248A
Patent Document 2: JP2015-161460A
Patent Document 3: JP2018-91599A

SUMMARY

Technical Problem

In the cooling channel structure disclosed in JP 2018-91599 A, since a cooling medium flows through the tubular structure only in one direction in the axial direction, it is necessary to install an inlet and an outlet for the cooling medium on one end side and another end side of the tubular structure, respectively. Thus, if the tubular structure has a configuration in which the inlet and the outlet for the cooling medium can be installed only on one side of the tubular structure, such as a burner tube or a nozzle skirt of a rocket engine, the cooling channel structure of JP 2018-91599 A is not applicable.

In view of the above, an object of the present disclosure is to provide a cooling channel structure and a burner in which a tubular member is uniformly cooled while suppressing the increase in pressure loss of the cooling medium, and the cooling medium can enter and exit from one side of the tubular member.

Solution to Problem

In order to achieve the above object, a cooling channel structure according to the present disclosure includes a tubular member with openings at both ends. In an inner portion or on a surface of the tubular member, as cooling channels for flowing a cooling medium for cooling the tubular member, provided are a plurality of spiral outer surface-side channels located on an outer surface side of the tubular member, at least one inner surface-side channel located on an inner surface side of the tubular member, and a plurality of folded channels, respectively, connecting the plurality of outer surface-side channels and the at least one inner surface-side channel on one end side of the tubular member.

Advantageous Effects

According to the present disclosure, provided are a cooling channel structure and a burner in which a tubular member is uniformly cooled while suppressing an increase in pressure loss of a cooling medium, and the cooling medium can enter and exit from one side of the tubular member.

DETAILED DESCRIPTION

Figure 1:
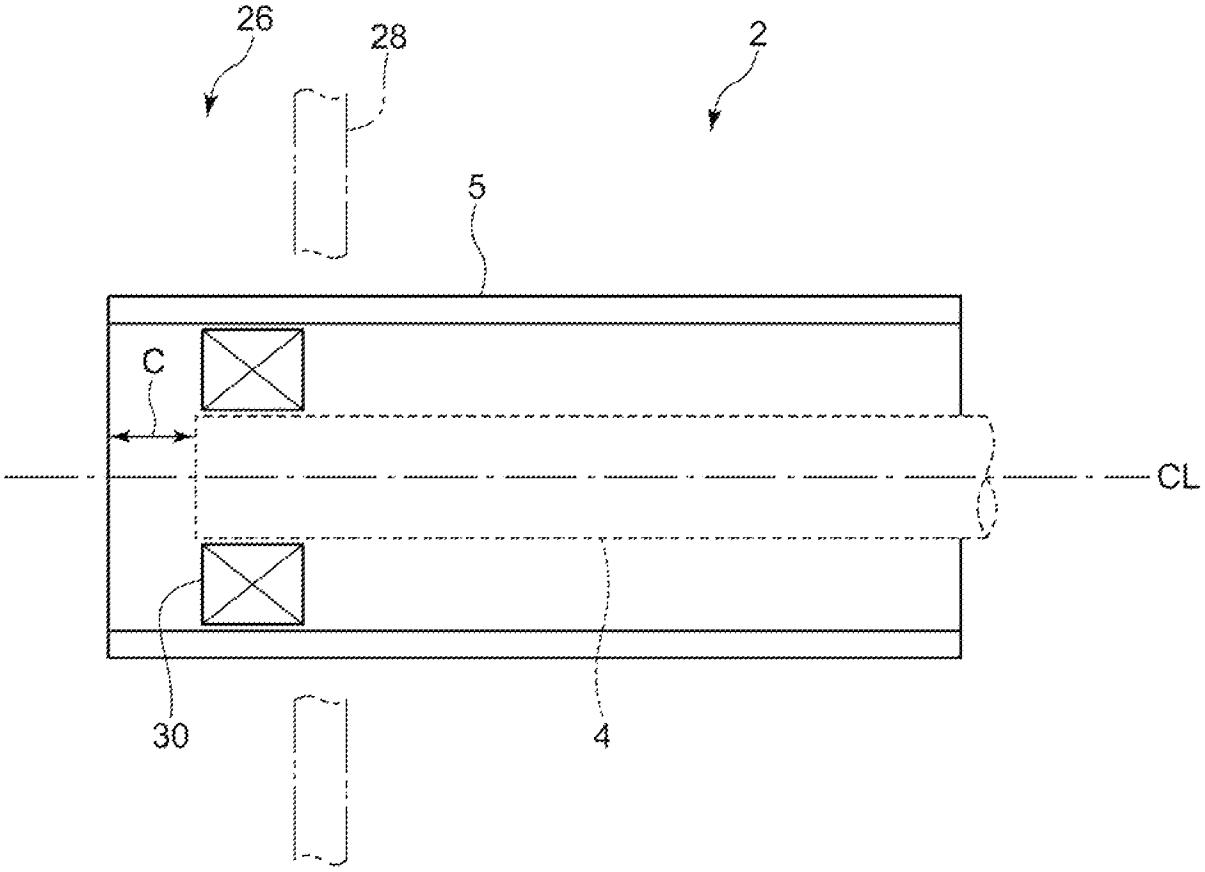
FIG. 1 is a vertical cross-sectional view showing the schematic configuration of a burner 2 according to an embodiment.

Embodiments of the present disclosure will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same", "equal", and "uniform" shall not be construed as indicating only the state in which the feature is strictly equal, but also includes a state in which there is a tolerance or a difference that can still achieve the same function.

Further, for instance, an expression of a shape such as a rectangular shape or a tubular shape shall not be construed as only the geometrically strict shape, but also includes a shape with unevenness or chamfered corners within the range in which the same effect can be achieved.

On the other hand, the expressions "comprising", "including", "having", "containing", and "constituting" one constituent component are not exclusive expressions that exclude the presence of other constituent components.

FIG. 1 is a vertical cross-sectional view showing the schematic configuration of a burner 2 according to an embodiment. The burner 2 is applied to, for example, a gasification furnace for a coal gasification device or the like, a conventional boiler, an incinerator, a gas turbine combustor, or an engine.

The burner 2 includes a fuel nozzle 4 for injecting fuel, and a burner tube 5 disposed around the fuel nozzle 4 on the same axis CL as the fuel nozzle 4, for guiding air serving as an oxidant for combusting the fuel. The burner tube 5 is a tubular member having openings at both ends, respectively, and functions as a shield tube for shielding heat. A swirler 30 is disposed between the outer peripheral surface of the fuel nozzle 4 and the inner peripheral surface of the burner tube 5. The burner tube 5 is disposed to penetrate a wall 28 of a combustion chamber 26 where flame is formed. The proximal end side of the burner tube 5 is located outside the combustion chamber 26, and the distal end side of the burner tube 5 is located inside the combustion chamber 26. On the proximal end side of the burner tube 5, for example, a flange or the like may be disposed to be connected to an air supply pipe (not shown) for supplying air.

Hereinafter, the axial direction of the burner tube 5 will simply be referred to as the "axial direction", the radial direction of the burner tube 5 will simply be referred to as the "radial direction", and the circumferential direction of the burner tube 5 will simply be referred to as the "circumferential direction". Further, hereinafter, an inner portion of the burner tube 5 means a thick inner portion of the burner tube 5.

Figure 2:
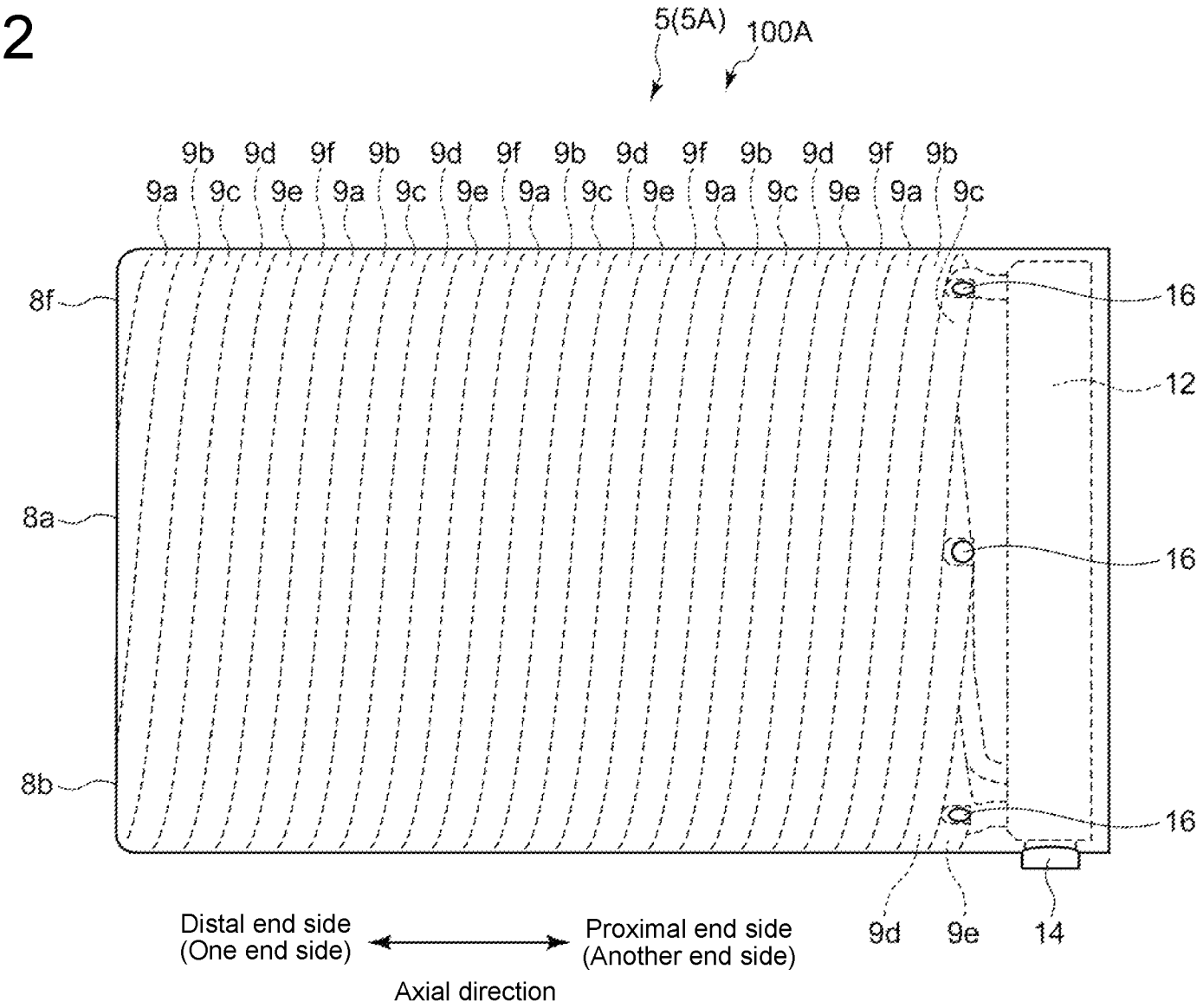
FIG. 2 is a side view of a burner tube 5 (5A) according to an embodiment.
Figure 3:
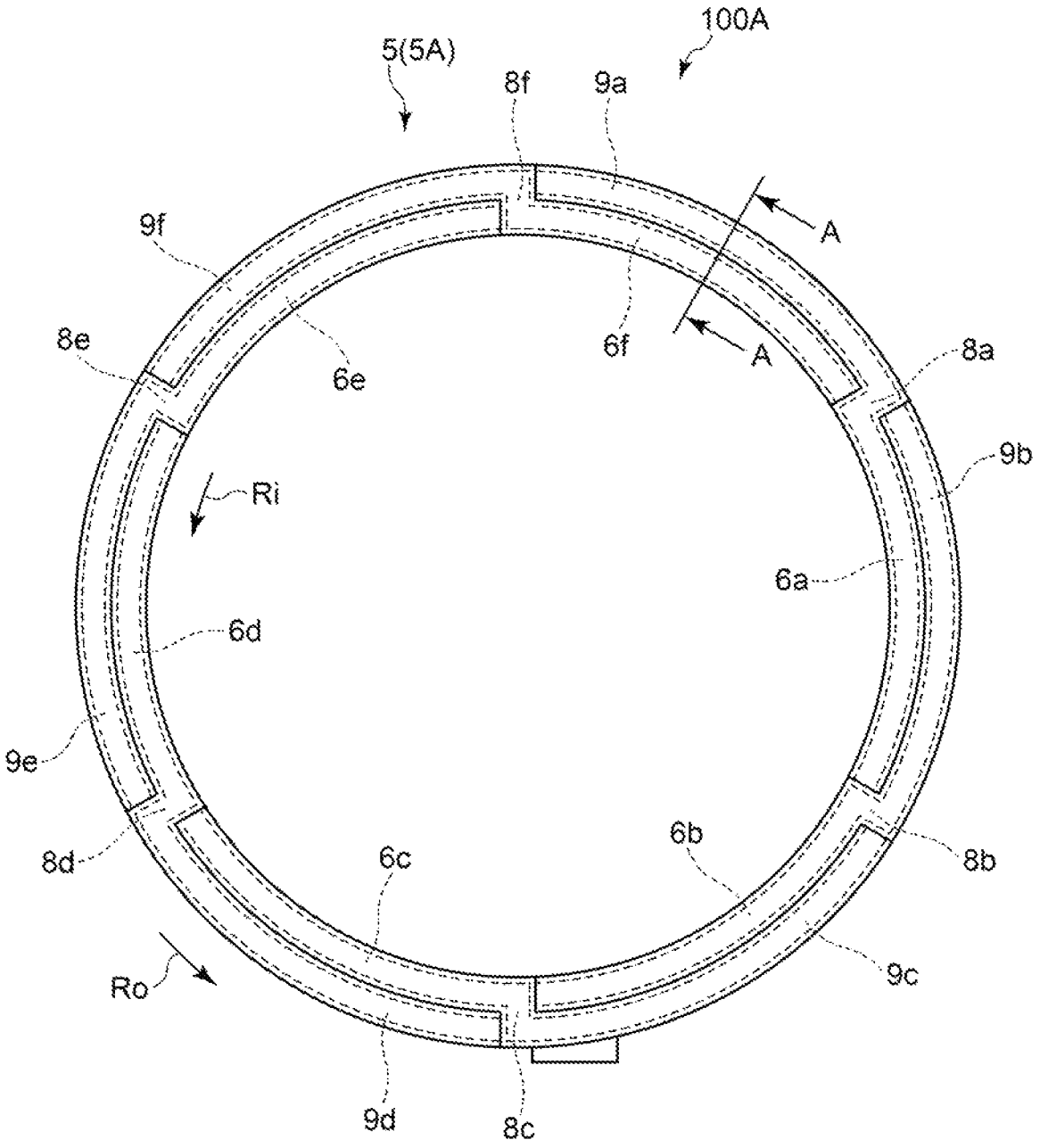
FIG. 3 is a front view of the burner tube 5 (5A).
Figure 4:
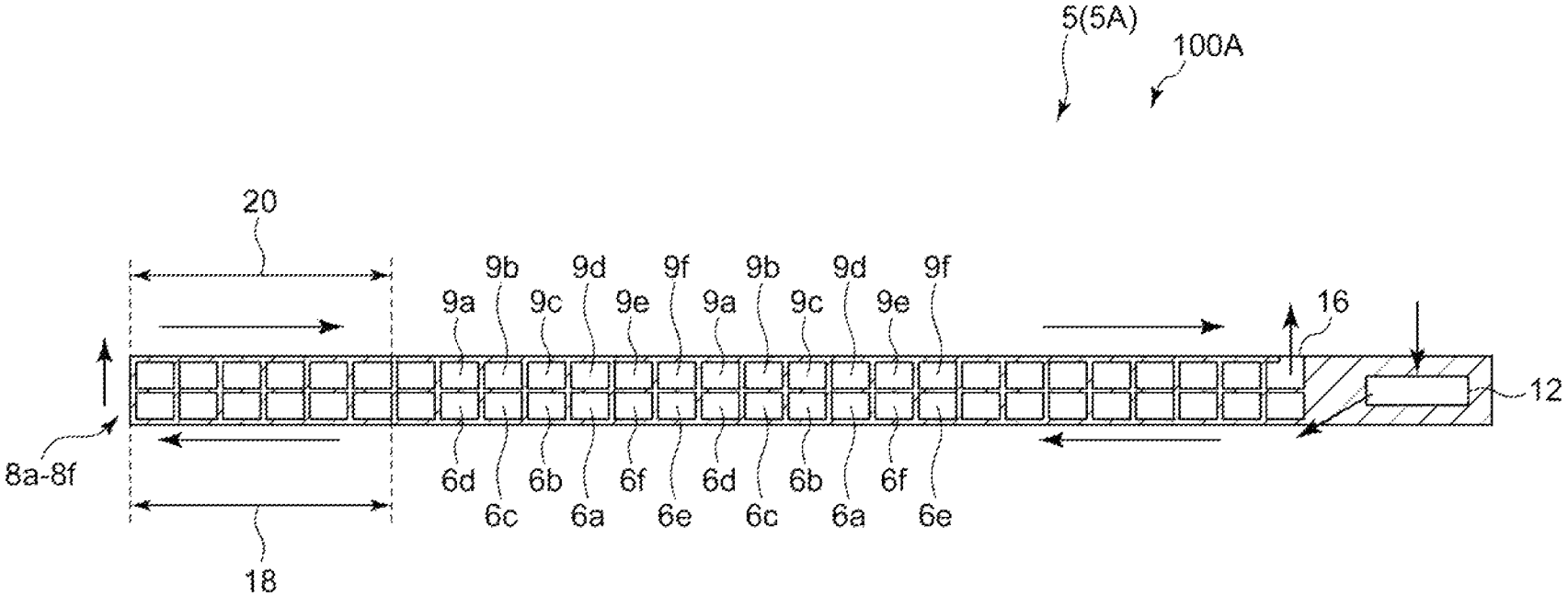
FIG. 4 is a cross-sectional view of the burner tube 5 (5A) taken along line A-A shown in FIG. 3.
Figure 5:
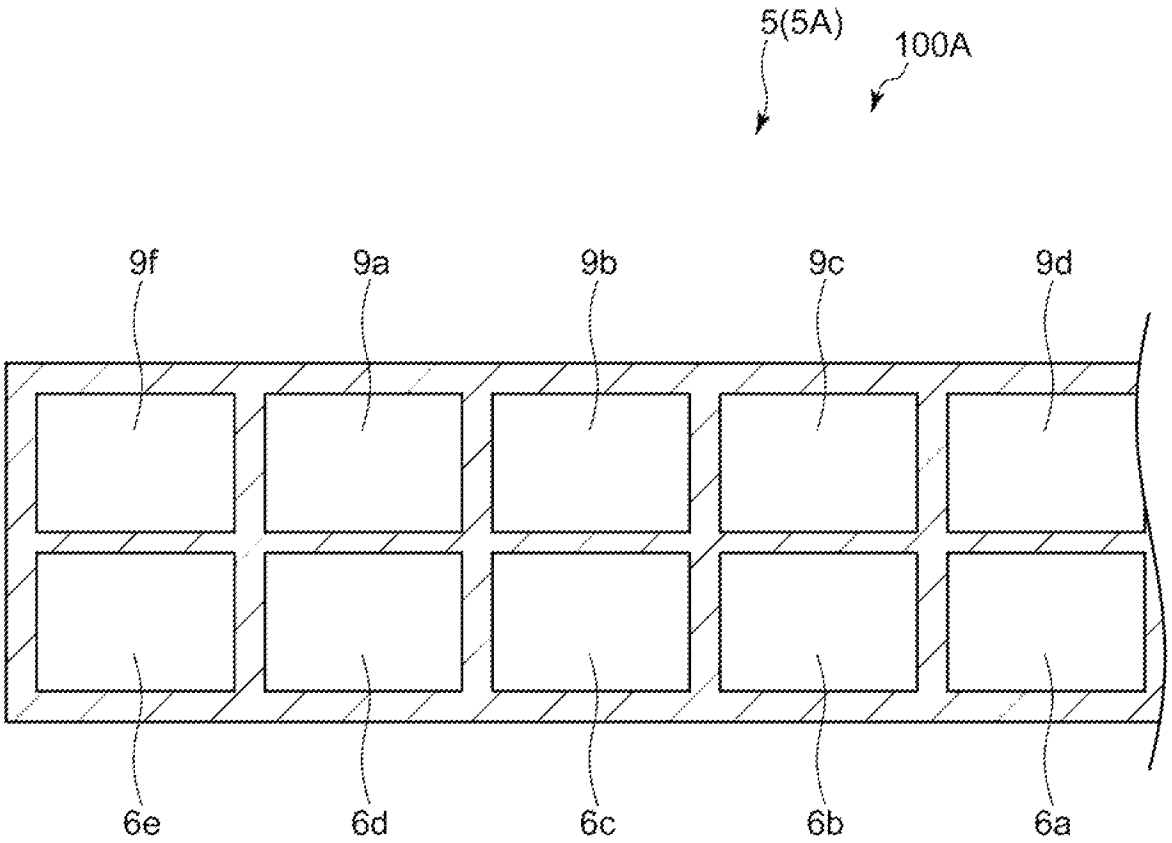
FIG. 5 is a partially enlarged view of the burner tube 5 (5A) taken along line A-A shown in FIG. 3.

Next, an example of the schematic configuration of the burner tube 5 will be described with reference to FIGS. 2 to 5. FIG. 2 is a side view of a burner tube 5 (5A) according to an embodiment. FIG. 3 is a front view of the burner tube 5 (5A). FIG. 4 is a cross-sectional view of the burner tube 5 (5A) taken along line A-A shown in FIG. 3. FIG. 5 is a partially enlarged view of the burner tube 5 (5A) taken along line A-A shown in FIG. 3.

As shown in FIGS. 2 to 5, in an inner portion of the burner tube 5 (5A), as cooling channels for flowing a cooling medium, provided are a plurality of spiral inner surface-side channels 6*a* to 6*f* located on an inner surface side of the burner tube 5, a plurality of spiral outer surface-side channels 9*a* to 9*f* located on an outer surface side of the burner tube 5, and a plurality of folded channels 8*a* to 8*f*, respectively, connecting the plurality of inner surface-side channels 6*a* to 6*f* and the plurality of outer surface-side channels 9*a* to 9*f* on a distal end side (one end side) of the burner tube 5.

In the illustrated exemplary embodiment, the six inner surface-side channels 6*a* to 6*f* are disposed on the inner surface side of the burner tube 5, the six outer surface-side channels 9*a* to 9*f* are disposed on the outer surface side of the burner tube 5, and the six folded channels 8*a* to 8*f* are disposed on the distal end side of the burner tube 5.

The folded channel 8*a* connects the inner surface-side channel 6*a* and the outer surface-side channel 9*a*, the folded channel 8*b* connects the inner surface-side channel 6*b* and the outer surface-side channel 9*b*, the folded channel 8*c* connects the inner surface-side channel 6*c* and the outer surface-side channel 9*c*, the folded channel 8*d* connects the inner surface-side channel 6*d* and the outer surface-side channel 9*d*, the folded channel 8*e* connects the inner surface-side channel 6*e* and the outer surface-side channel 9*e*, and the folded channel 8*f* connects the inner surface-side channel 6*f* and the outer surface-side channel 9*f*.

For example, as shown in FIGS. 4 and 5, in a cross-section along the axial direction of the burner tube 5, a channel cross-section of the inner surface-side channel 6*a*, a channel cross-section of the inner surface-side channel 6*b*, a channel cross-section of the inner surface-side channel 6*c*, a channel cross-section of the inner surface-side channel 6*d*, a channel cross-section of the inner surface-side channel 6*e*, and a channel cross-section of the inner surface-side channel 6*f* are arranged so as to repeat in this order from the proximal end side to the distal end side of the burner tube 5 along the axial direction.

Further, for example, as shown in FIGS. 4 and 5, in the cross-section along the axial direction of the burner tube 5, a channel cross-section of the outer surface-side channel 9*a*, a channel cross-section of the outer surface-side channel 9*b*, a channel cross-section of the outer surface-side channel 9*c*, a channel cross-section of the outer surface-side channel 9*d*, a channel cross-section of the outer surface-side channel 9*e*, and a channel cross-section of the outer surface-side channel 9*f* are arranged so as to repeat in this order from the distal end side to the proximal end side of the burner tube 5 along the axial direction.

Further, for example, as shown in FIGS. 2 and 4, in the inner portion of the burner tube 5, a header 12, which extends in the circumferential direction so as to connect end portions of the plurality of inner surface-side channels 6*a* to 6*f* on the proximal end side, is disposed on the proximal end side of the burner tube 5. As shown in FIG. 2, an inlet 14 for the cooling medium is disposed on the proximal end side of the burner tube 5, and the header 12 is connected to the inlet 14 which is open in the radial direction. The cooling medium flowing into the burner tube 5 from the inlet 14 separately flows into the plurality of inner surface-side channels 6*a* to 6*f* through the header 12, and is discharged from outlets 16 in the plurality of outer surface-side channels 9*a* to 9*f* on the proximal end side of the burner tube 5 through the folded channels 8*a* to 8*f*, respectively.

More specifically, the cooling medium flowing into the inner surface-side channel 6*a* from the header 12 is discharged from the burner tube 5 at the outlet 16 in the outer surface-side channel 9*a* through the inner surface-side channel 6*a*, the folded channel 8*a*, and the outer surface-side channel 9*a* in order. The cooling medium flowing into the inner surface-side channel 6*b* from the header 12 is discharged from the burner tube 5 at the outlet 16 in the outer surface-side channel 9*b* through the inner surface-side channel 6*b*, the folded channel 8*b*, and the outer surface-side channel 9*b* in order. The cooling medium flowing into the inner surface-side channel 6*c* from the header 12 is discharged from the burner tube 5 at the outlet 16 in the outer surface-side channel 9*c* through the inner surface-side channel 6*c*, the folded channel 8*c*, and the outer surface-side channel 9*c* in order. The cooling medium flowing into the inner surface-side channel 6*d* from the header 12 is discharged from the burner tube 5 at the outlet 16 in the outer surface-side channel 9*d* through the inner surface-side channel 6*d*, the folded channel 8*d*, and the outer surface-side channel 9*d* in order. The cooling medium flowing into the inner surface-side channel 6*e* from the header 12 is discharged from the burner tube 5 at the outlet 16 in the outer surface-side channel 9*e* through the inner surface-side channel 6*e*, the folded channel 8*e*, and the outer surface-side channel 9*e* in order. The cooling medium flowing into the inner surface-side channel 6*f* from the header 12 is discharged from the burner tube 5 at the outlet 16 in the outer surface-side channel 9*f* through the inner surface-side channel 6*f*, the folded channel 8*f*, and the outer surface-side channel 9*f* in order.

Further, for example, as shown in FIG. 3, the folded channels 8*a* to 8*f* are curved such that a direction Ri in which the inner surface-side channels 6*a* to 6*f* rotate toward a downstream side along a spiral (a direction in which the cooling medium rotates as it moves through the inner surface-side channels 6*a* to 6*f* toward the downstream side along the spiral), and a direction Ro in which the outer surface-side channels 9*a* to 9*f* rotate toward the downstream side along the spiral (a direction in which the cooling medium rotates as it moves through the outer surface-side channels 9*a* to 9*f* toward the downstream side along the spiral) are the same direction. In the illustrated form, when the burner tube 5 is viewed from the distal end side to the proximal end side thereof along the axial direction, the direction Ri in which the inner surface-side channels 6*a* to 6*f* rotate toward the downstream side along the spiral and the direction Ro in which the outer surface-side channels 9*a* to 9*f* rotate toward the downstream side along the spiral are both counterclockwise and are the same direction as each other.

In the burner tube 5 (5A) shown in FIGS. 2 to 5, the cooling channels, through which the cooling medium for cooling the burner tube 5 (5A) flows, are formed in the inner portion of the burner tube 5 (5A) itself (the thick inner portion of the burner tube 5), and the burner tube 5 (5A) itself constitutes a cooling channel structure 100A. Such burner tube 5 (5A) can be produced by using, for example, a three-dimensional additive manufacturing device (so-called 3D printer). The cooling medium flowing through the cooling channels (the inner surface-side channels 6*a* to 6*f*, the folded channels 8*a* to 8*f*, and the outer surface-side channels 9*a* to 90 may be, for example, a liquid such as water or oil, or a gas such as air.

With the above configuration, since the plurality of spiral outer surface-side channels 9*a* to 9*f* are disposed on the outer surface side of the burner tube 5, as compared with a case where only the cooling channels along the axial direction are used to cool the burner tube (for example, see JP 2015-161460 A), it is possible to suppress non-uniform cooling of the burner tube 5 and to uniformly cool the burner tube 5. Therefore, even if a distribution of a heat load on the burner tube 5 is biased, it is possible to uniformly cool the burner tube 5.

Further, as compared with a case where only one spiral outer surface-side channel is disposed on the outer surface side of the burner tube 5, it is possible to decrease a channel length per spiral outer surface-side channel required to cover the same area, making it possible to suppress an increase in pressure loss and to reduce a driving force for feeding the cooling medium. Thus, it is possible to efficiently cool the burner tube 5 by using a drive source such as a pump or a fan having a small driving force.

Further, since the plurality of inner surface-side channels 6*a* to 6*f* and the plurality of outer surface-side channels 9*a* to 9*f* are connected via the plurality of folded channels 8*a* to 8*f*, respectively, on the distal end side of the burner tube 5, it is possible to aggregate the inlet 14 and the outlets 16 for the cooling medium in the burner tube 5 on the proximal end side of the burner tube 5.

Therefore, it is possible to uniformly cool the burner tube 5 while suppressing the increase in pressure loss of the cooling medium, and to provide the burner tube 5 in which the cooling medium can enter and exit from one side (proximal end side) of the burner tube 5.

Further, since the folded channels 8*a* to 8*f* are curved such that the direction Ri in which the inner surface-side channels 6*a* to 6*f* rotate toward the downstream side along the spiral and the direction Ro in which the outer surface-side channels 9*a* to 9*f* rotate toward the downstream side along the spiral are the same direction, it is possible to smoothly reverse a flow direction of the cooling medium in the axial direction, and to suppress the increase in pressure loss of the cooling medium.

Further, since the header 12 connecting the end portions of the plurality of inner surface-side channels 6*a* to 6*f* is disposed on the proximal end side of the burner tube 5, it is unnecessary to individually connect each of the inner surface-side channels 6*a* to 6*f* and an external cooling medium pipe, making it possible to reduce the process of connecting each of the inner surface-side channels 6*a* to 6*f* to the external cooling medium pipe.

Figure 6:
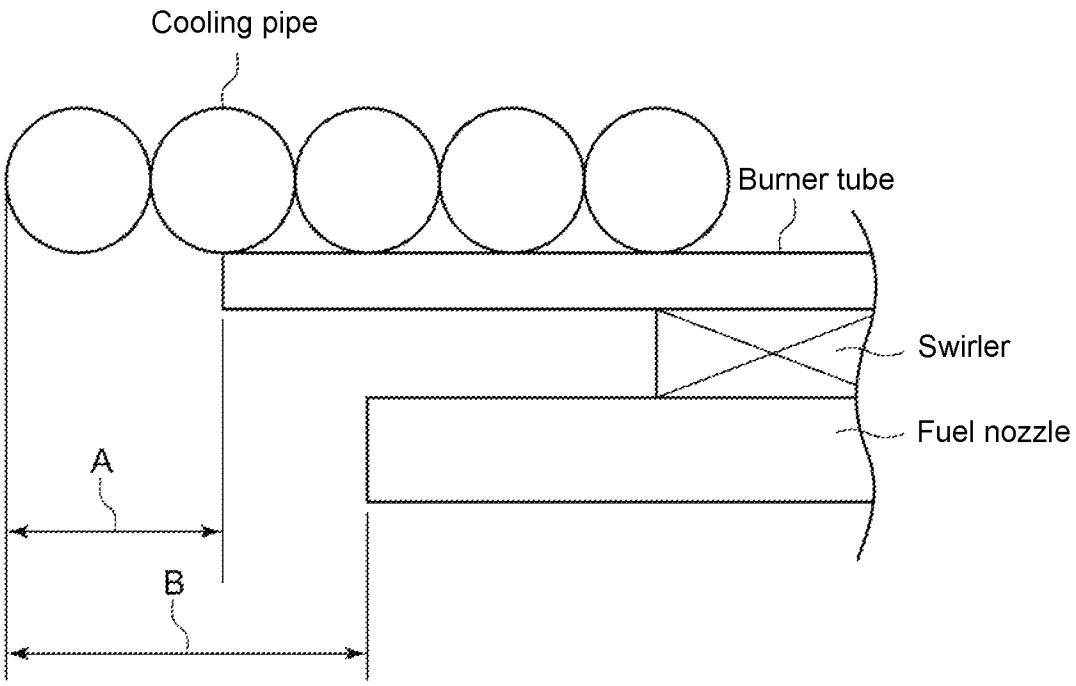
FIG. 6 is a vertical cross-sectional view showing the schematic configuration of the burner tube according to a comparative embodiment.

Further, since the burner tube 5, which internally includes the spiral inner surface-side channels 6*a* to 6*f* and the spiral outer surface-side channels 9*a* to 9*f*, can be configured as one component by the three-dimensional additive manufacturing device, as compared with a case where the burner tube and cooling pipes are formed by separate components (for example, a case where the spiral cooling pipes are wound on the outer surface of the burner tube as shown in FIG. 6), alignment between the respective components and dimensional management become easy.

For example, in the configuration shown in FIG. 6, it is necessary to appropriately manage an axial protrusion amount A of the respective tips of the cooling pipes relative to the tip of the burner tube and an axial protrusion amount B of the respective tips of the cooling pipes relative to the tip of the fuel nozzle, whereas in the burner tube 5 shown in FIGS. 1 to 5, instead of the protrusion amount A and the protrusion amount B described above, it is only necessary to appropriately manage a protrusion amount C (see FIG. 1) of the tip of the burner tube 5 relative to the tip of the fuel nozzle 4, facilitating alignment between the respective components and dimensional management.

Further, the water-cooled jacket structure described in JP 2015-161460 A is produced by applying channel groove processing to the outer circumferential surface of the inner tube and then sealing a channel groove with the outer tube.

However, in this case, the large number of production steps is likely to increase production costs, and there are many problems such as reliability regarding leakage from a close contact portion between the inner tube and the outer tube. In contrast, since the above-described burner tube 5 can produce the inner surface-side channels 6*a* to 6*f*, the folded channels 8*a* to 8*f*, and the outer surface-side channels 9*a* to 9*f* described above integrally with the burner tube 5 by the three-dimensional additive manufacturing device, it is possible to reduce the number of components, the number of production steps, and the production costs, and it is unnecessary to perform the above-described channel groove sealing process. Further, the inner surface-side channels 6*a* to 6*f*, the folded channels 8*a* to 8*f*, and the outer surface-side channels 9*a* to 9*f* described above can be configured to each have an appropriate channel cross-sectional area according to a flow velocity required by the cooling medium, and it is possible to effectively cool the burner tube 5.

In some embodiments, each of the inner surface-side channels 6*a* to 6*f* may include a section in which the channel cross-sectional area changes according to the axial position. For example, as shown in FIG. 4, the inner surface-side channels 6*a* to 6*f* may include a channel section 18 in which the channel cross-sectional areas decrease toward the folded channels 8*a* to 8*f*, respectively (toward the downstream side). Further, each of the outer surface-side channels 9*a* to 9*f* may include a section in which the channel cross-sectional area changes according to the axial position. For example, as shown in FIG. 4, the outer surface-side channels 9*a* to 9*f* may include a channel section 20 in which the channel cross-sectional areas decrease toward the folded channels 8*a* to 8*f*, respectively (toward the upstream side).

In the burner 2, the ambient temperature of the burner tube 5 tends to increase toward the distal end side. Thus, as described above, providing the inner surface-side channels 6*a* to 6*f* with the channel section 18 in which the channel cross-sectional areas decrease toward the folded channels 8*a* to 8*f* on the distal end side, it is possible to effectively cool the burner tube 5 by increasing the flow velocity of the cooling medium in a region where the ambient temperature in the channel section 18 tends to be high. Further, as described above, providing the outer surface-side channels 9*a* to 9*f* with the channel section 20 in which the channel cross-sectional areas decrease toward the folded channels 8*a* to 8*f* on the distal end side, it is possible to effectively cool the burner tube 5 by increasing the flow velocity of the cooling medium in a region where the ambient temperature in the channel section 20 tends to be high.

Thus, in the case where the heat load distribution can be assumed in advance, by changing the channel cross-sectional areas of the inner surface-side channels 6*a* to 6*f* and the outer surface-side channels 9*a* to 9*f* according to the axial positions, it is possible to reduce a thermal stress caused in the burner tube 5. In another embodiment, for example, in the channel section 18 and the channel section 20 shown in FIG. 4, cross-sectional shapes of the inner surface-side channels 6*a* to 6*f* and cross-sectional shapes of the outer surface-side channels 9*a* to 9*f* may be changed according to the axial positions, together with the channel cross-sectional areas or instead of the channel cross-sectional areas.

Next, some other embodiments will be described. In other embodiments to be described below, unless otherwise stated, common reference characters with those for the respective constituent components in the aforementioned embodiments denote the same constituent components as those for the respective constituent components in the aforementioned embodiments, and the description thereof will be omitted.

Figure 7:
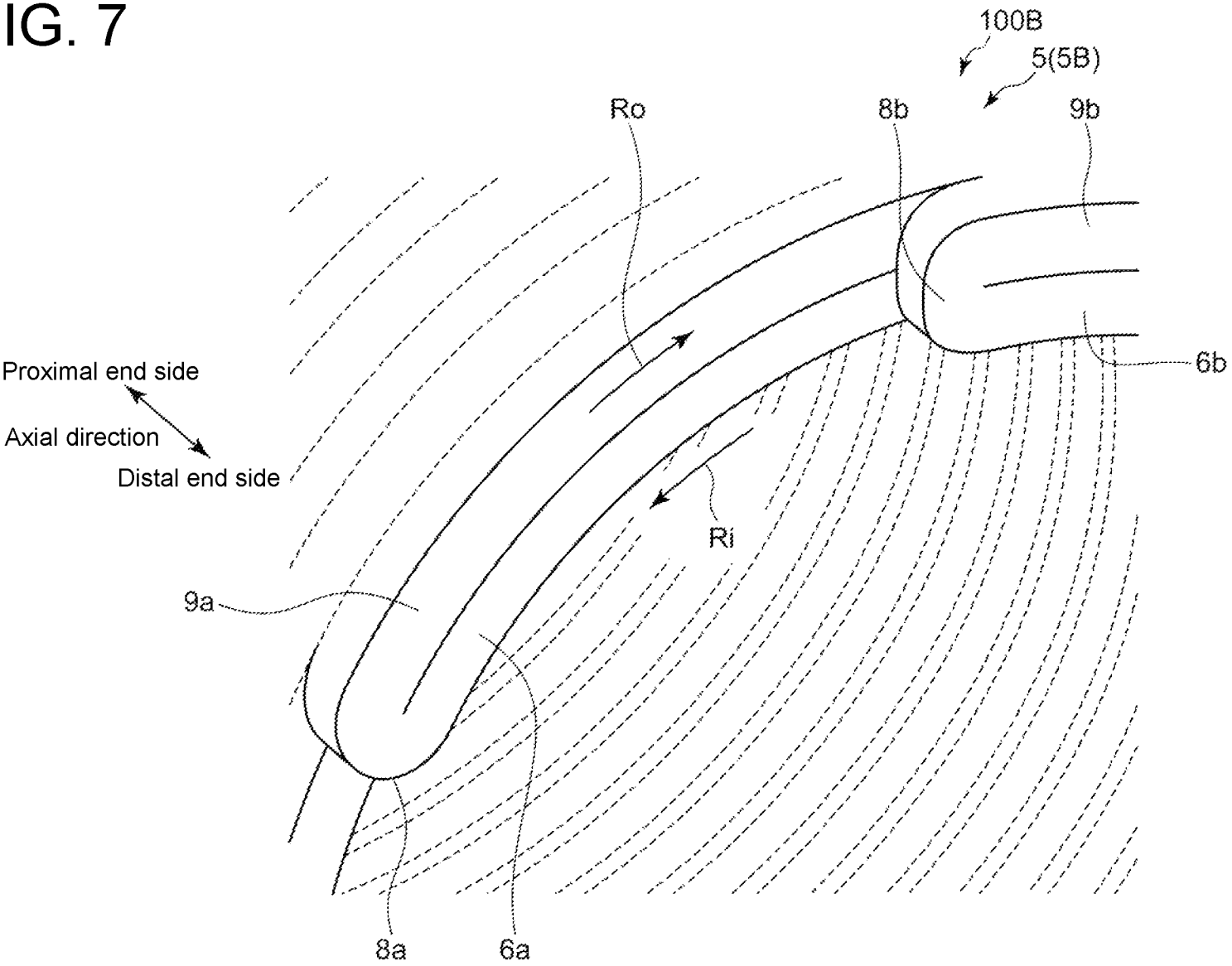
FIG. 7 is a partially enlarged perspective view of a burner tube 5 (5B) according to another embodiment.

FIG. 7 is a partially enlarged perspective view of a burner tube 5 (5B) according to another embodiment.

In some embodiments, for example, as partially shown in FIG. 7, the folded channels 8*a* to 8*f* are curved such that the direction Ri in which the inner surface-side channels 6*a* to 6*f* rotate toward the downstream side along the spiral (the direction in which the cooling medium rotates as it moves through the inner surface-side channels 6*a* to 6*f* toward the downstream side along the spiral), and the direction Ro in which the outer surface-side channels 9*a* to 9*f* rotate toward the downstream side along the spiral (the direction in which the cooling medium rotates as it moves through the outer surface-side channels 9*a* to 9*f* toward the downstream side along the spiral) are opposite to each other. In the illustrated form, when the burner tube 5 is viewed from the distal end side to the proximal end side thereof along the axial direction, the direction Ri in which the inner surface-side channels 6*a* to 6*f* rotate toward the downstream side along the spiral is counterclockwise, and the direction Ro in which the outer surface-side channels 9*a* to 9*f* rotate toward the downstream side along the spiral is clockwise, being opposite to each other.

In the burner tube 5 (5B) shown in FIG. 7, the cooling channels, through which the cooling medium for cooling the burner tube 5 (5B) flows, are formed in the inner portion of the burner tube 5 (5B) itself (the thick inner portion of the burner tube 5), and the burner tube 5 (5B) itself constitutes a cooling channel structure 100B.

With the configuration shown in FIG. 7, as compared with the folded channels 8*a* to 8*f* shown in FIG. 3, although the pressure loss is increased by reversing the flow direction of the cooling medium by 180 degrees in the folded channels 8*a* to 8*f*, it is possible to reduce the thermal stress caused in the folded channels 8*a* to 8*f*.

Figure 8:
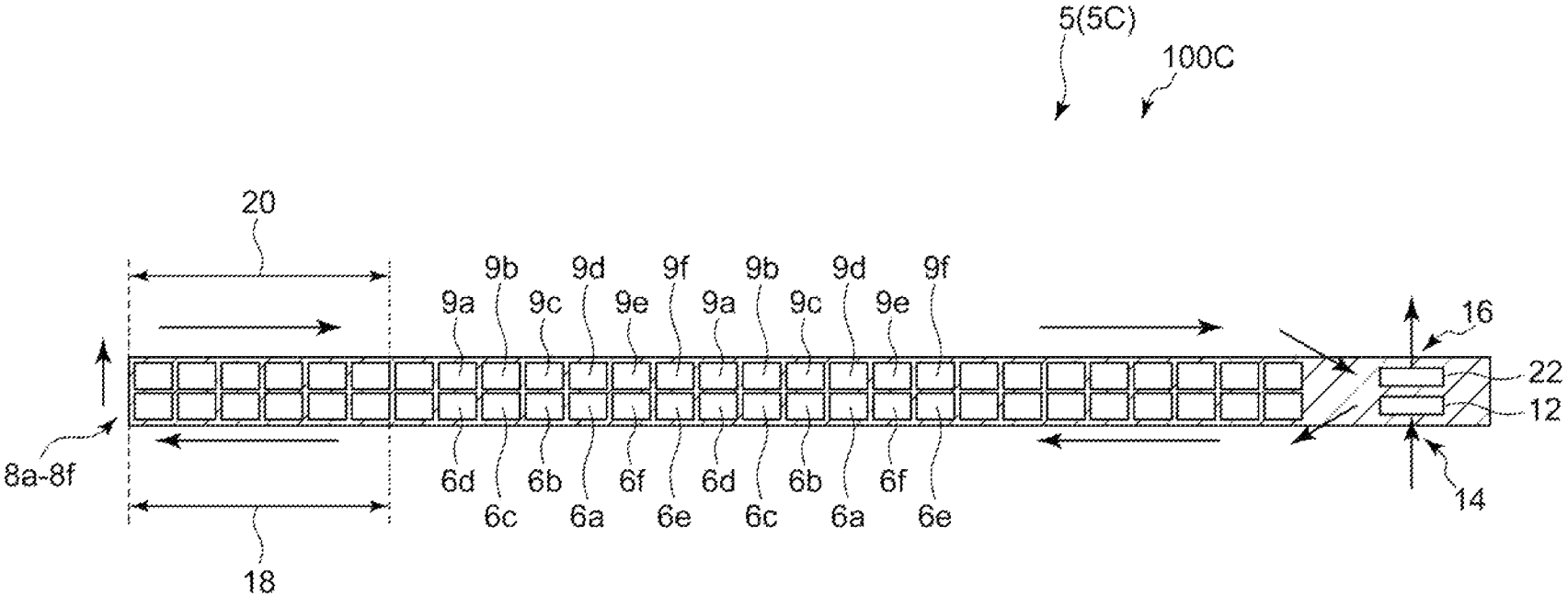
FIG. 8 is a vertical cross-sectional view of a burner tube 5 (5C) according to another embodiment.

FIG. 8 is a vertical cross-sectional view of a burner tube 5 (5C) according to another embodiment.

In some embodiments, for example, as shown in FIG. 8, the header 12, which extends in the circumferential direction so as to connect the end portions of the plurality of inner surface-side channels 6*a* to 6*f*, and a header 22, which extends in the circumferential direction so as to connect end portions of the plurality of outer surface-side channels 9*a* to 9*f*, are disposed on the proximal end side (another end side) of the burner tube 5. The header 22 is disposed on an outer peripheral side of the header 12.

In the burner tube 5 (5C) shown in FIG. 8, the cooling channels, through which the cooling medium for cooling the burner tube 5 (5C) flows, are formed in the inner portion of the burner tube 5 (5C) itself (the thick inner portion of the burner tube 5), and the burner tube 5 (5C) itself constitutes a cooling channel structure 100C.

With the configuration shown in FIG. 8, it is possible to have one inlet and one outlet for the cooling medium in the burner tube 5. That is, it is unnecessary to individually connect each of the inner surface-side channels 6*a* to 6*f* and the external cooling medium pipe, making it possible to reduce the process of connecting each of the inner surface-side channels 6*a* to 6*f* to the external cooling medium pipe. Further, it is unnecessary to individually connect each of the outer surface-side channels 9*a* to 9*f* and the external cooling medium pipe, making it possible to reduce the process of connecting each of the outer surface-side channels 9*a* to 9*f* to the external cooling medium pipe.

Figure 9:
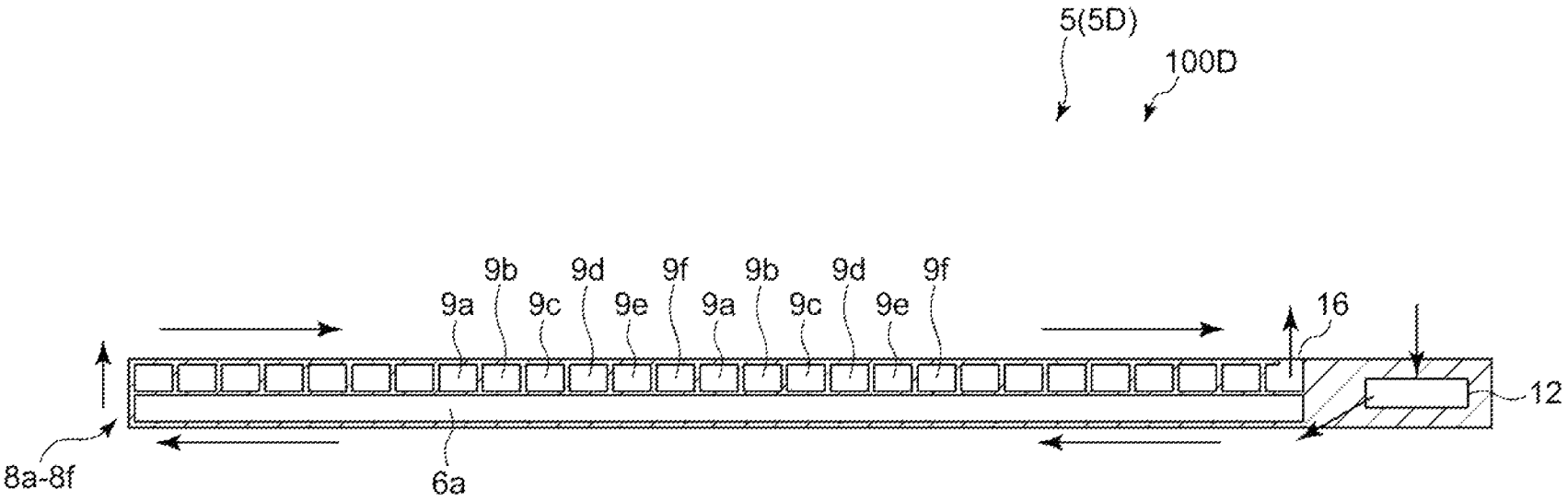
FIG. 9 is a vertical cross-sectional view of a burner tube 5 (5D) according to another embodiment.

FIG. 9 is a vertical cross-sectional view of a burner tube 5 (5D) according to another embodiment.

In some embodiments, for example, as partially shown in FIG. 9, each of the inner surface-side channels 6*a* to 6*f* may extend not spirally but linearly along the axial direction. In the burner tube 5 (5D) shown in FIG. 9, the cooling channels, through which the cooling medium for cooling the burner tube 5 (5D) flows, are formed in the inner portion of the burner tube 5 (5D) itself (the thick inner portion of the burner tube 5), and the burner tube 5 (5D) itself constitutes a cooling channel structure 100D.

By adopting a jacket structure as shown in FIG. 9, as compared with the case where each of the inner surface-side channels 6*a* to 6*f* is formed into the spiral shape, it is possible to reduce the pressure loss by decreasing the channel lengths of the inner surface-side channels 6*a* to 6*f*.

The present disclosure is not limited to the above-described embodiments, and also includes an embodiment obtained by modifying the above-described embodiments and an embodiment obtained by combining these embodiments as appropriate.

For example, in the embodiment shown in FIG. 8, the configuration is described in which the plurality of inner surface-side channels 6*a* to 6*f* linearly extending along the axial direction are disposed in the inner portion of the burner tube 5. However, only one inner surface-side channel may be disposed. If the burner tube 5 has only one inner surface-side channel, the inner surface-side channel may be formed in an annular shape in the burner tube.

Further, in some embodiments described above, the cases where the burner tubes 5 (5A to 5D) themselves constitute the cooling channel structures, respectively, have been exemplified. That is, the configuration has been exemplified in which the plurality of inner surface-side channels 6*a* to 6*f*, the plurality of folded channels 8*a* to 8*f*, and the plurality of outer surface-side channels 9*a* to 9*f* are integrally disposed in the inner portion of the burner tube 5 by a three-dimensional additive manufacturing method. However, the burner tube 5 and the components constituting the cooling channels may be separate components.

Figure 10:
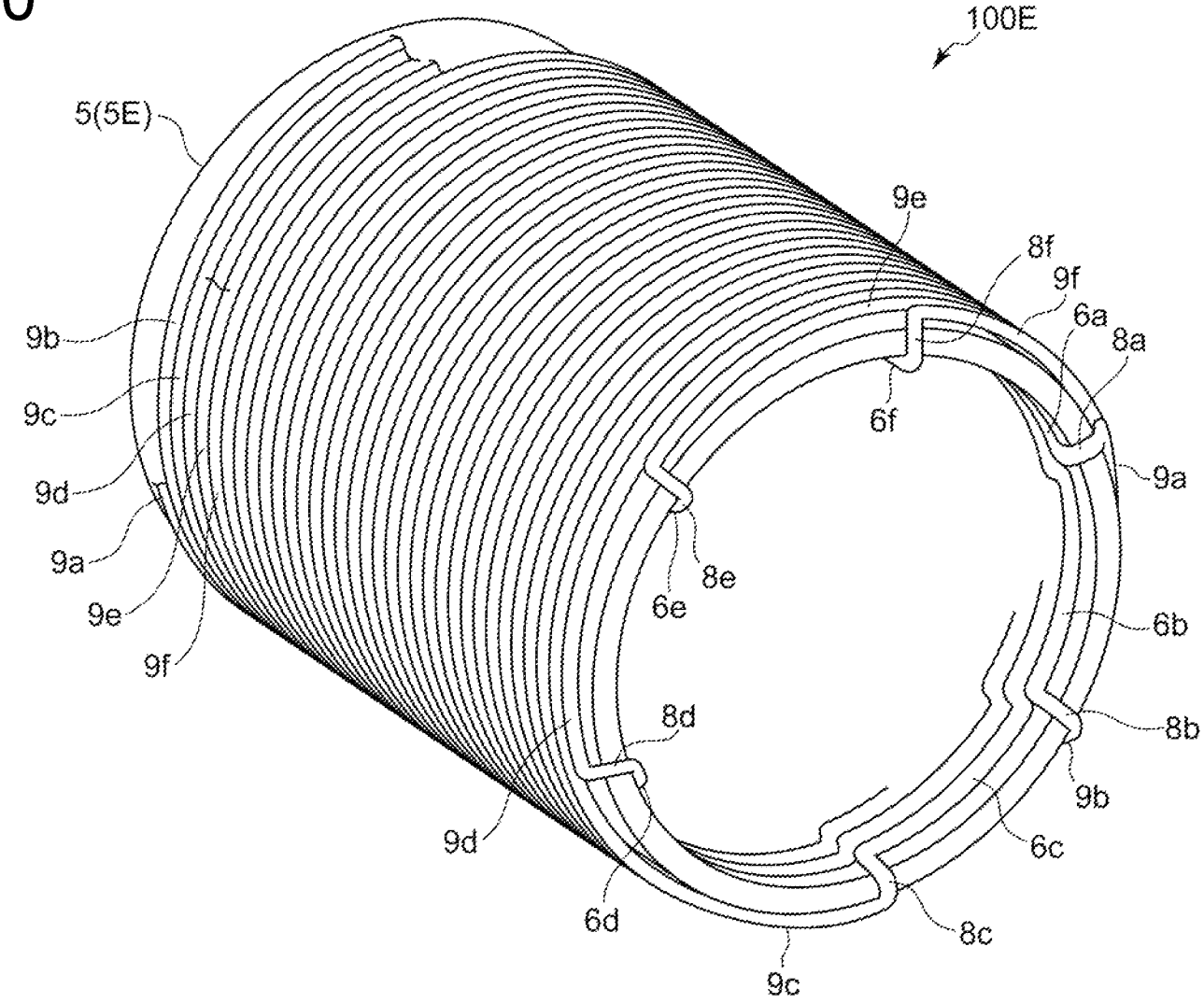
FIG. 10 is a perspective view showing the schematic configuration of a burner tube 5 (5E) according to another embodiment.

In the configuration shown in FIG. 10, each of the plurality of spiral inner surface-side channels 6*a* to 6*f* is constituted by a corresponding one of spiral cooling pipes disposed on an inner surface of a burner tube 5 (5E) along the inner surface of the burner tube 5, and each of the plurality of spiral outer surface-side channels 9*a* to 9*f* is constituted by a corresponding one of spiral cooling pipes disposed on the outer surface of the burner tube 5 along the outer surface of the burner tube 5. Further, the plurality of folded channels 8*a* to 8*f* are constituted by a plurality of cooling pipes which connect the plurality of cooling pipes constituting the inner surface-side channels 6*a* to 6*f* and the plurality of cooling pipes constituting the outer surface-side channels 9*a* to 9*f*, respectively.

In the configuration shown in FIG. 10, the burner tube 5 (5E), the cooling pipes respectively constituting the inner surface-side channels 6*a* to 6*f*, the cooling pipes respectively constituting the folded channels 8*a* to 8*f*, and the cooling pipes respectively constituting the outer surface-side channels 9*a* to 9*f* constitute a cooling channel structure 100E.

In the configuration shown in FIG. 10 as well, it is possible to uniformly cool the burner tube 5 while suppressing the increase in pressure loss of the cooling medium, and to provide the burner tube 5 in which the cooling medium can enter and exit from one side (proximal end side) of the burner tube 5.

Figure 11:
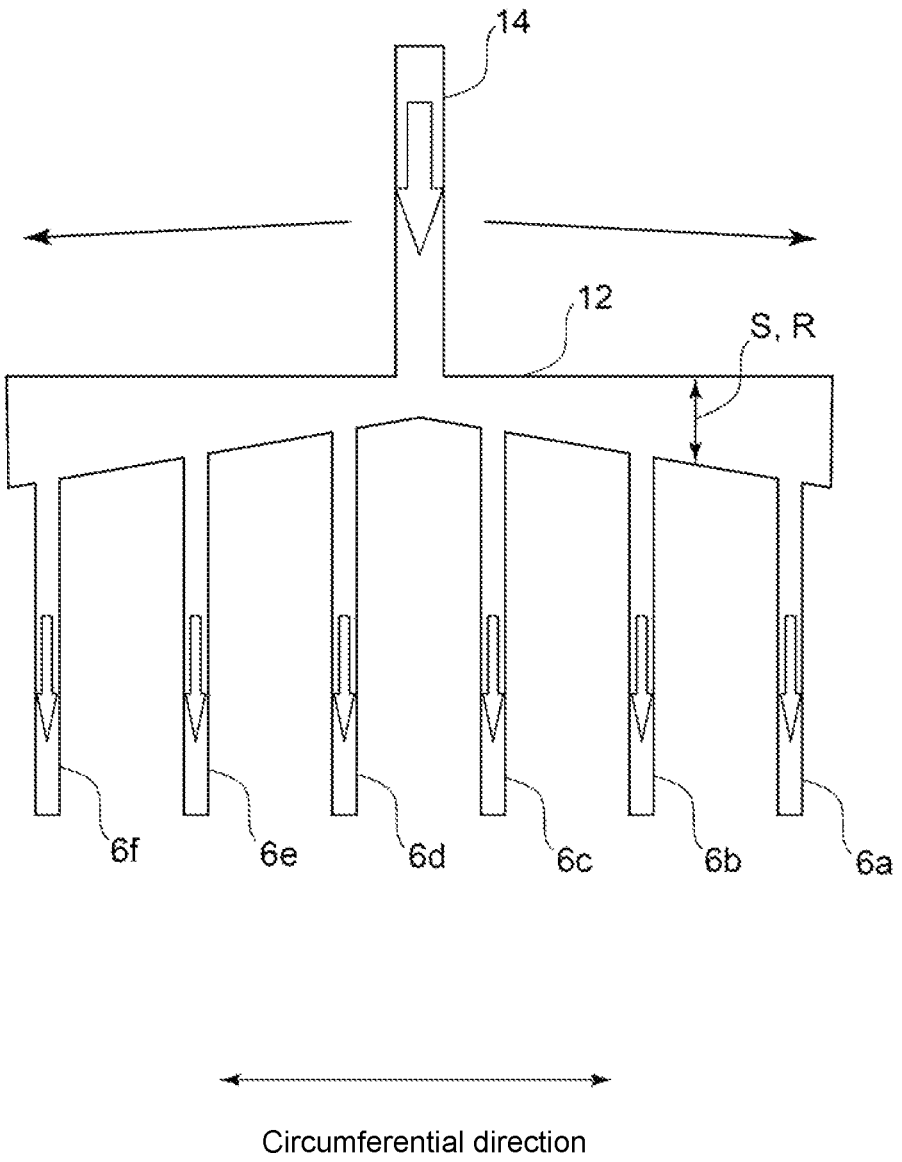
FIG. 11 is a schematic view showing the configuration example of a header 12 according to an embodiment.

Further, the header 12 shown in FIGS. 2, 3, 8, 9, and the like may be configured such that a channel cross-sectional area S and a header diameter R (channel diameter) of the header 12 expand as a distance from the inlet 14 for the cooling medium in the burner tube 5 increases, for example, as shown in FIG. 11.

Figure 12:
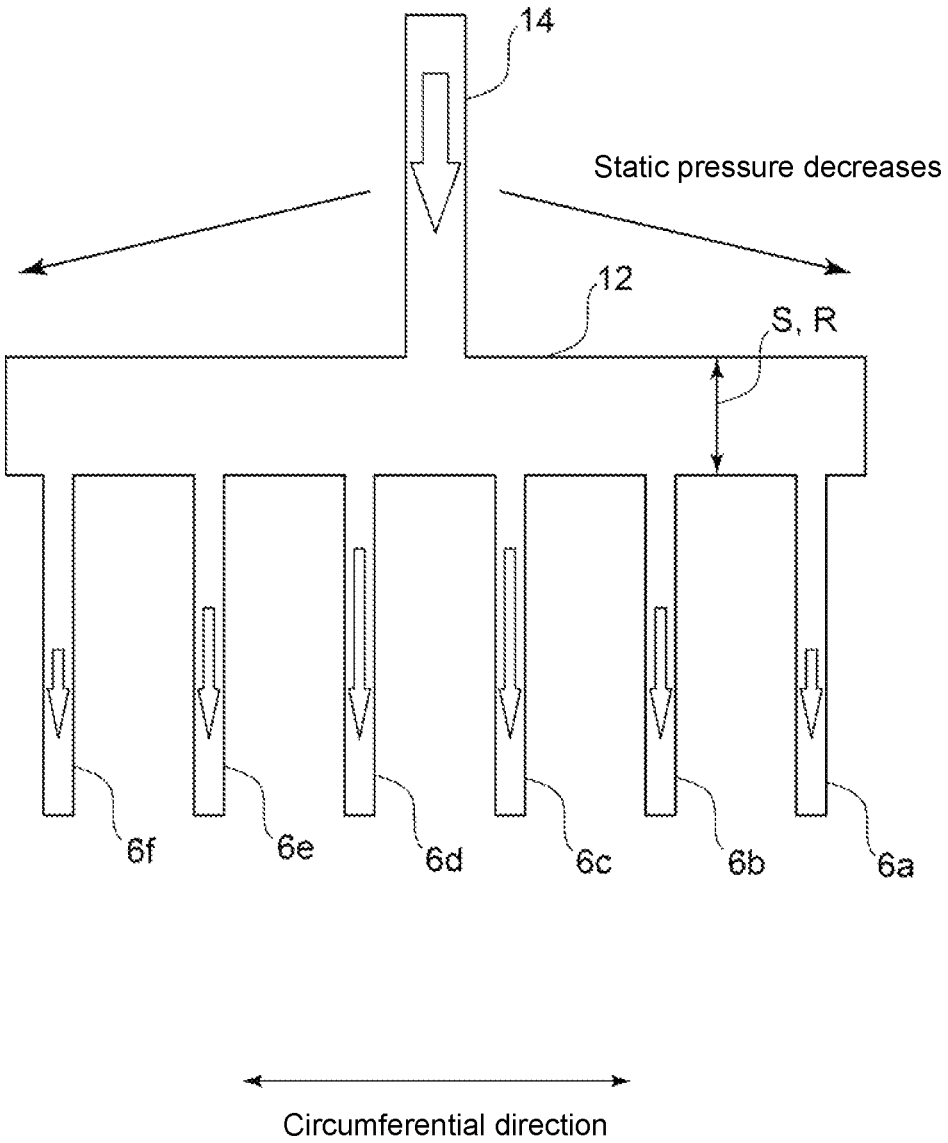
FIG. 12 is a schematic view showing the configuration example of the header 12 according to an embodiment.

Consequently, the flow velocity decreases as the channel area S expands in the header 12, as compared with a case where the channel cross-sectional area S and the header diameter R of the header 12 are constant as shown in FIG. 12, making it possible to suppress a decrease in static pressure (a pushing force of the cooling medium) at a position away from the inlet 14 in the header 12. Thus, it is possible to uniformly distribute the cooling medium by the inner surface-side channels 6 (6*a* to 6*f*).

Further, in the above-described burner tubes 5 (5A to 5E), the configuration example has been described in which the cooling medium flows in the order of the inner surface-side channels 6, the folded channels 8, and the outer surface-side channels 9. However, in the above configuration, the flow direction of the cooling medium may be opposite. That is, in the burner tubes 5 (5A to 5E), the cooling medium may flow in the order of the outer surface-side channels 9, the folded channels 8, and the inner surface-side channels 6.

Figure 13:
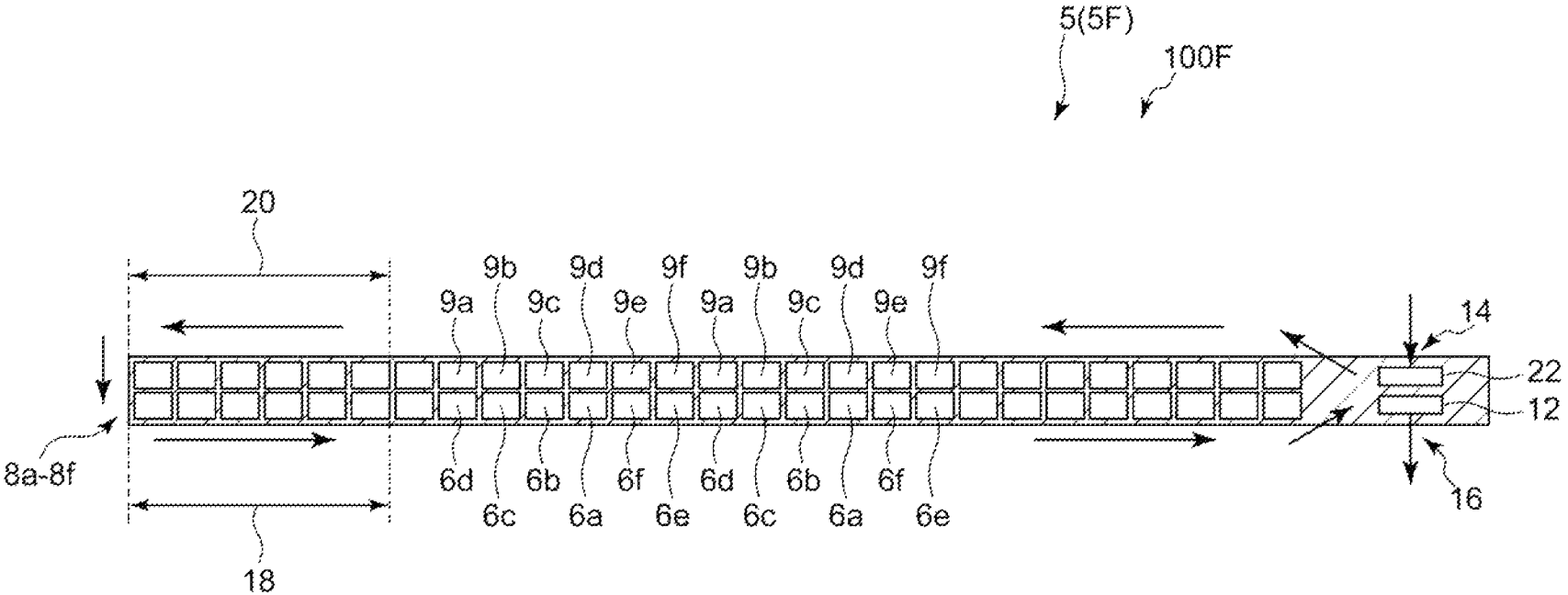
FIG. 13 is a vertical cross-sectional view of a burner tube 5 (5F) according to another embodiment.

In this case, for example, as shown in FIG. 13, the header 22 is connected to the inlet 14 for the cooling medium in the burner tube 5, and the header 12 is connected to the outlet 16 for the cooling medium in the burner tube 5. Further, in this case, the header 22 may be configured such that a channel cross-sectional area and a header diameter of the header 12 expand as the distance from the inlet 14 for the cooling medium in the burner tube 5 increases.

In a burner tube 5 (5F) shown in FIG. 13, the cooling channels, through which the cooling medium for cooling the burner tube 5 (5F) flows, are formed in the inner portion of the burner tube 5 (5F) itself (the thick inner portion of the burner tube 5), and the burner tube 5 (5F) itself constitutes a cooling channel structure 100F.

Further, in some embodiments described above, the cases where the burner tubes 5 (5A to 5F) constitute the cooling channel structures, respectively, have been exemplified. The same cooling channel structure as the above cooling channel structures may be applied to a nozzle skirt of a rocket engine.

Figure 14:
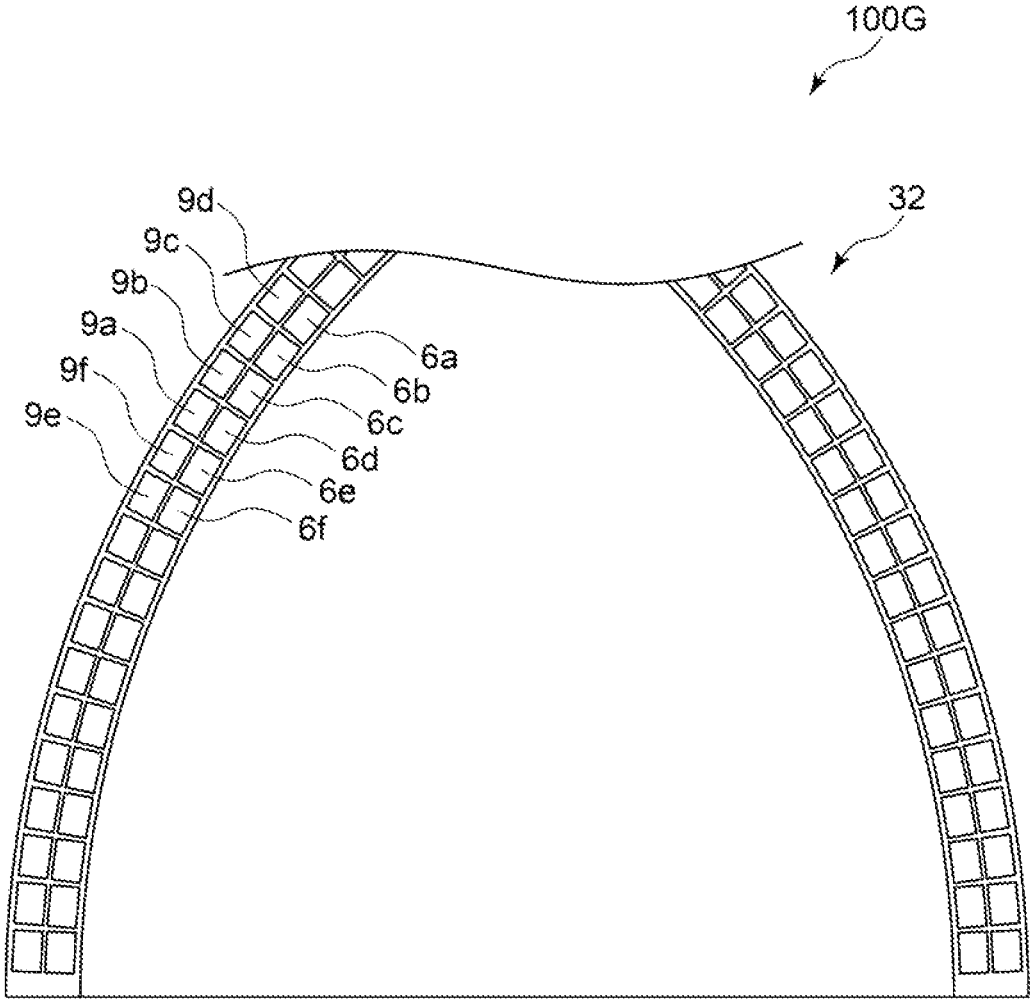
FIG. 14 is a partial cross-sectional view showing the schematic configuration of a nozzle skirt 32 of a rocket engine according to another embodiment.

FIG. 14 is a partial cross-sectional view showing the schematic configuration of a nozzle skirt 32 of a rocket engine according to another embodiment.

The nozzle skirt 32 of the rocket engine shown FIG. 14 is a tubular member with both ends thereof being open, and in an inner portion of the nozzle skirt 32 (a thick inner portion of the nozzle skirt 32), as the cooling channels for flowing the cooling medium, disposed are the plurality of spiral inner surface-side channels 6*a* to 6*f* located on an inner surface side of the nozzle skirt 32, the plurality of spiral outer surface-side channels 9*a* to 9*f* located on an outer surface side of the nozzle skirt 32, and the plurality of folded channels 8*a* to 8*f*, respectively, connecting the plurality of inner surface-side channels 6*a* to 6*f* and the plurality of outer surface-side channels 9*a* to 9*f* on a distal end side (one end side) of the nozzle skirt. In the illustrated form, each of the spiral inner surface-side channels 6*a* to 6*f* is configured such that the radius thereof increases toward the distal end side of the nozzle skirt 32. Further, each of the spiral outer surface-side channels 9*a* to 9*f* is configured such that the radius thereof increases toward the distal end side of the nozzle skirt 32.

In the nozzle skirt 32 shown in FIG. 14, the cooling channels, through which the cooling medium for cooling the nozzle skirt 32 flows, are formed in the inner portion of the nozzle skirt 32 itself (the thick inner portion of the nozzle skirt 32), and the nozzle skirt 32 itself constitutes a cooling channel structure 100G.

In the above configuration as well, it is possible to uniformly cool the nozzle skirt 32 while suppressing the increase in pressure loss of the cooling medium, and to provide the nozzle skirt 32 in which the cooling medium can enter and exit from one side (proximal end side) of the burner tube 5.

The contents described in the above embodiments would be understood as follows, for instance.

(1) A cooling channel structure (such as the above-described cooling channel structures 100A to 100G) according to the present disclosure includes a tubular member (such as the above-described burner tube 5 (5A to 5E) or nozzle skirt 32) with openings at both ends. In an inner portion or on a surface of the tubular member, as cooling channels for flowing a cooling medium for cooling the tubular member, provided are a plurality of spiral outer surface-side channels (such as the above-described outer surface-side channels 9*a* to 90 located on an outer surface side of the tubular member, at least one inner surface-side channel (such as the above-described inner surface-side channels 6*a* to 60 located on an inner surface side of the tubular member, and a plurality of folded channels (such as the above-described folded channels 8*a* to 80, respectively, connecting the plurality of outer surface-side channels and the at least one inner surface-side channel on one end side of the tubular member.

With the cooling channel structure according to the above configuration (1), since the plurality of spiral outer surface-side channels are disposed on the outer surface side of the tubular member, as compared with a case where only the cooling channels along the axial direction are used to cool the tubular member, it is possible to suppress non-uniform cooling of the tubular member and to uniformly cool the tubular member.

Further, as compared with a case where only one spiral outer surface-side channel is disposed on the outer surface side of the tubular member, it is possible to decrease a channel length per spiral outer surface-side channel required to cover the same area, making it possible to suppress an increase in pressure loss and to reduce a driving force for feeding the cooling medium. Thus, it is possible to efficiently cool the tubular member by using a drive source such as a pump or a fan having a small driving force.

Further, since the plurality of inner surface-side channels and the plurality of outer surface-side channels are connected via the plurality of folded channels, respectively, on the one end side of the tubular member, it is possible to aggregate the inlet and the outlets for the cooling medium in the tubular member on another end side of the tubular member.

Therefore, it is possible to provide a cooling channel structure in which the tubular member is uniformly cooled while suppressing the increase in pressure loss of the cooling medium, and the cooling medium can enter and exit from one side of the tubular member.

(2) In some embodiments, in the cooling channel structure according to the above configuration (1), the plurality of outer surface-side channels, the at least one inner surface-side channel, and the plurality of folded channels are disposed in an inner portion or on a surface of the tubular member.

As in the above configuration (2), the plurality of outer surface-side channels, the at least one inner surface-side channel, and the plurality of folded channels may be disposed in the inner portion of the tubular member (in the tubular member itself), or may be disposed on the surface of the tubular member (as separate components from the tubular member).

(3) In some embodiments, the cooling channel structure according to the above configuration (1) or (2) includes an inlet for the cooling medium disposed on another end side of the tubular member, and an outlet for the cooling medium disposed on the another end side of the tubular member.

In the cooling channel structure according to the above configuration (3), since the inlet and the outlet for the cooling medium are aggregated on the another end side of the tubular member, it is possible to provide the cooling channel structure in which the tubular member is uniformly cooled while suppressing the increase in pressure loss of the cooling medium, and the cooling medium can enter and exit from one side of the tubular member.

(4) In some embodiments, in the cooling channel structure according to any one of the above configurations (1) to (3), a plurality of inner surface-side channels located on the inner surface side of the tubular member are disposed in an inner portion or on a surface of the tubular member, and each of the plurality of inner surface-side channels is formed into a spiral shape.

With the cooling channel structure according to the above configuration (4), it is possible to provide the cooling channel structure in which the tubular member is cooled more uniformly, and the cooling medium can enter and exit from one side in the axial direction.

(5) In some embodiments, in the cooling channel structure according to the above configuration (4), the folded channels are curved such that a direction in which the outer surface-side channels rotate toward a downstream side along a spiral and a direction in which the inner surface-side channels rotate toward the downstream side along the spiral are opposite to each other.

With the cooling channel structure according to the above configuration (5), it is possible to reduce a thermal stress caused in the folded channels.

(6) In some embodiments, in the cooling channel structure according to the above configuration (4), the folded channels are curved such that a direction in which the outer surface-side channels rotate toward a downstream side along a spiral and a direction in which the inner surface-side channels rotate toward the downstream side along the spiral are the same as each other.

With the cooling channel structure according to the above configuration (6), it is possible to smoothly reverse a flow direction of the cooling medium in the axial direction by the folded channels, and to suppress the increase in pressure loss.

(7) In some embodiments, in the cooling channel structure according to any one of the above configurations (1) to (3), a plurality of inner surface-side channels located on the inner surface side of the tubular member are disposed in an inner portion or on a surface of the tubular member, and each of the plurality of inner surface-side channels linearly extends along an axial direction of the tubular member.

With the cooling channel structure according to the above configuration (7), as compared with the case where each of the inner surface-side channels is formed into the spiral shape, it is possible to reduce the pressure loss by decreasing the channel length of the inner surface-side channel.

(8) In some embodiments, the cooling channel structure according to any one of the above configurations (4) to (7) further includes a header (such as the above-described header 12) connecting end portions of the plurality of inner surface-side channels, on another end side of the tubular member.

With the cooling channel structure according to the above configuration (8), it is unnecessary to individually connect each of the inner surface-side channels and the external cooling medium pipe, making it possible to reduce the process of connecting each of the inner surface-side channels to the external cooling medium pipe.

(9) In some embodiments, the cooling channel structure according to any one of the above configurations (1) to (7) further includes a header (such as the above-described header 22) connecting end portions of the plurality of outer surface-side channels, on another end side of the tubular member.

With the cooling channel structure according to the above configuration (9), it is unnecessary to individually connect each of the outer surface-side channels and the external cooling medium pipe, making it possible to reduce the process of connecting each of the outer surface-side channels to the external cooling medium pipe.

(10) In some embodiments, in the cooling channel structure according to the above configuration (8) or (9), the header is connected to an inlet for the cooling medium in the tubular member, and the header has a channel cross-sectional area expanding as a distance from the inlet increases.

With the cooling channel structure according to the above configuration (10), the flow velocity decreases as the channel cross-sectional area expands in the header, as compared with a case where the channel cross-sectional area of the header is constant, making it possible to suppress a decrease in static pressure (a pushing force of the cooling medium) at a position away from the inlet in the header. Thus, it is possible to uniformly distribute the cooling medium by the plurality of inner surface-side channels.

(11) In some embodiments, in the cooling channel structure according to any one of the above configurations (1) to (10), at least either the outer surface-side channels or the inner surface-side channel includes a section (such as the above-described channel section 18 and channel section 20) in which a channel cross-sectional area changes according to an axial position of the tubular member.

In this case, only the outer surface-side channels of the outer surface-side channels and the inner surface-side channel may include the section in which the channel cross-sectional area changes according to the axial position of the tubular member, only the inner surface-side channel of the outer surface-side channels and the inner surface-side channel may include the section in which the channel cross-sectional area changes according to the axial position of the tubular member, or the outer surface-side channels and the inner surface-side channel may each include the section in which the channel cross-sectional area changes according to the axial position of the tubular member.

With the cooling channel structure according to the above configuration (11), since the channel cross-sectional area of at least either the outer surface-side channels or the inner surface-side channel is changed in the above-described section according to the heat load distribution in the tubular member, it is possible to effectively reduce the thermal stress caused in the tubular member.

(12) In some embodiments, in the cooling channel structure according to the above configuration (11), at least either the outer surface-side channels or the inner surface-side channel includes a section (such as the above-described channel section 18 and channel section 20) in which the channel cross-sectional area decreases toward the folded channels.

In this case, only the outer surface-side channels of the outer surface-side channels and the inner surface-side channel may include the section in which the channel cross-sectional area decreases toward the folded channels, only the inner surface-side channel of the outer surface-side channels and the inner surface-side channel may include the section in which the channel cross-sectional area decreases toward the folded channels, or the outer surface-side channels and the inner surface-side channel may each include the section in which the channel cross-sectional area decreases toward the folded channels.

With the cooling channel structure according to the above configuration (12), in the case where the ambient temperature increases as the tubular member approaches one end side (such as the case where the tubular member is the burner tube or the like), it is possible to effectively cool the tubular member by increasing the flow velocity of the cooling medium in a region where the ambient temperature in the above-described section tends to be high, and to effectively reduce the thermal stress caused in the tubular member.

(13) In some embodiments, in the cooling channel structure according to any one of the above configurations (1) to (12), at least either the outer surface-side channels or the inner surface-side channel includes a section (such as the above-described channel section 18 and channel section 20) in which a cross-sectional shape changes according to an axial position of the tubular member.

In this case, only the outer surface-side channels of the outer surface-side channels and the inner surface-side channel may include the section in which the cross-sectional shape changes according to the axial position of the tubular member, only the inner surface-side channel of the outer surface-side channels and the inner surface-side channel may include the section in which the cross-sectional shape changes according to the axial position of the tubular member, or the outer surface-side channels and the inner surface-side channel may each include the section in which the cross-sectional shape changes according to the axial position of the tubular member.

With the cooling channel structure according to the above configuration (13), since the cross-sectional shape of at least either the outer surface-side channels or the inner surface-side channel is changed in the above-described section according to the heat load distribution in the tubular member, it is possible to effectively reduce the thermal stress caused in the tubular member.

(14) A burner according to the present disclosure includes the cooling channel structure according to any one of the above configurations (1) to (13).

Since the burner according to the above configuration (14) includes the cooling channel structure according to any one of the above configurations (1) to (13), it is possible to suppress non-uniform cooling of the tubular member (burner tube), and to uniformly cool the tubular member.

Further, as compared with a case where only one spiral outer surface-side channel is disposed on the outer surface side of the tubular member, it is possible to decrease a channel length per spiral outer surface-side channel required to cover the same area, making it possible to suppress an increase in pressure loss and to reduce a driving force for feeding the cooling medium. Thus, it is possible to efficiently cool the tubular member by using a drive source such as a pump or a fan having a small driving force.

Further, since the plurality of inner surface-side channels and the plurality of outer surface-side channels are connected via the plurality of folded channels, respectively, on the one end side of the tubular member, it is possible to aggregate the inlet and the outlets for the cooling medium in the tubular member on another end side of the tubular member.

REFERENCE SIGNS LIST

2 Burner
4 Fuel nozzle
5 (5A-5E) Burner tube
6*a*-6*f* Inner surface-side channel
8*a*-8*f* Folded channel
9*a*-9*f* Outer surface-side channel
12 Header
14 Inlet
16 Outlet
18 Channel section
20 Channel section
22 Header
24 Air supply pipe
26 Combustion chamber
28 Wall
30 Swirler
32 Nozzle skirt
100A-100G Cooling channel structure

The invention claimed is:

1. A cooling channel structure, comprising:
a tubular member with openings at both ends; and
cooling channels for a cooling medium for cooling the tubular member, the cooling channels including:
spiral outer surface-side channels on an outer surface side of the tubular member;
spiral inner surface-side channels on an inner surface side of the tubular member in an inner portion of the tubular member or on a surface of the tubular member; and
folded channels, respectively, connecting the spiral outer surface-side channels and the spiral inner surface-side channels on one end side of the tubular member,
wherein the folded channels are curved such that a first direction in which the spiral outer surface-side channels curve toward a downstream side along a spiral and a second direction in which the spiral inner surface-side channels curve toward the downstream side along the spiral are opposite to each other.

2. The cooling channel structure according to claim 1,
wherein the spiral outer surface-side channels, and the folded channels are in the inner portion of the tubular member or on the surface of the tubular member.

3. The cooling channel structure according to claim 1, wherein the one end side of the tubular member is a first end side of the tubular member and the cooling channel structure further comprises:
an inlet for the cooling medium on a second end side of the tubular member; and
an outlet for the cooling medium on the second end side of the tubular member.

4. The cooling channel structure according to claim 1, wherein the one end side of the tubular member is a first end side of the tubular member and the cooling channel structure further comprises:
a header connecting end portions of the spiral outer surface-side channels, on a second end side of the tubular member.

5. The cooling channel structure according to claim 1,
wherein at least the spiral outer surface-side channels or the spiral inner surface-side channels include a section in which a channel cross-sectional area changes according to an axial position of the tubular member.

6. The cooling channel structure according to claim 5,
wherein at least the spiral outer surface-side channels or the spiral inner surface-side channels include a section in which the channel cross-sectional area decreases toward the folded channels.

7. The cooling channel structure according to claim 1,
wherein at least the spiral outer surface-side channels or the spiral inner surface-side channels include a section in which a cross-sectional shape changes according to an axial position of the tubular member.

8. A burner, comprising:
the cooling channel structure according to claim 1.

9. A cooling channel structure, comprising:
a tubular member with openings at both ends; and
cooling channels for a cooling medium for cooling the tubular member, the cooling channels including:
spiral outer surface-side channels on an outer surface side of the tubular member;
spiral inner surface-side channels on an inner surface side of the tubular member in an inner portion of the tubular member or on a surface of the tubular member; and
folded channels, respectively, connecting the spiral outer surface-side channels and the spiral inner surface-side channels on one end side of the tubular member,
wherein the folded channels are curved such that a first direction in which the spiral outer surface-side channels curve toward a downstream side along a spiral and a second direction in which the spiral inner surface-side channels curve toward the downstream side along the spiral are the same as each other.

10. A cooling channel structure, comprising:
a tubular member with openings at both ends;
a header; and
cooling channels for a cooling medium for cooling the tubular member, the cooling channels including:
spiral outer surface-side channels on an outer surface side of the tubular member;
spiral inner surface-side channels on an inner surface side of the tubular member in an inner portion of the tubular member or on a surface of the tubular member; and
folded channels, respectively, connecting the spiral outer surface-side channels and the spiral inner surface-side channels on a first end side of the tubular member,
wherein the header connects end portions of the spiral inner surface-side channels, on a second end side of the tubular member.

11. The cooling channel structure according to claim 10, wherein:
the header is connected to an inlet for the cooling medium in the tubular member; and
the header has a channel cross-sectional area which expands as a distance from the inlet increases.

* * * * *